United States Patent [19]

Bancroft

[11] Patent Number: 4,713,861

[45] Date of Patent: Dec. 22, 1987

[54] HINGE PIN

[75] Inventor: Joseph C. Bancroft, Longwood, Fla.

[73] Assignee: Croft Metals, Inc., McComb, Miss.

[21] Appl. No.: 874,567

[22] Filed: Jun. 16, 1986

[51] Int. Cl.[4] ..... E05D 11/00

[52] U.S. Cl. ..... 16/222; 16/263; 16/273

[58] Field of Search ..... 16/273, 271, 272, 263, 16/262, 261, 380, 381, 386, 222; 411/41, 40, 39

[56] References Cited

U.S. PATENT DOCUMENTS

| | | | |
|---|---|---|---|
| 2,941,439 | 6/1960 | Rapata | 411/41 |
| 3,015,126 | 1/1962 | Ahlgren | 16/386 |
| 3,264,678 | 8/1966 | Parmelee | 16/386 |
| 4,375,342 | 3/1983 | Wollar | 411/41 |

FOREIGN PATENT DOCUMENTS

| | | | |
|---|---|---|---|
| 447768 | 4/1966 | Japan | 411/41 |

*Primary Examiner*—Nicholas P. Godici
*Assistant Examiner*—G. Reid
*Attorney, Agent, or Firm*—Macdonald J. Wiggins

[57] ABSTRACT

A hinge pin and bushing assembly is provided for machine insertion into a barrel of a hinge leaf. The assembly is preferably molded in one piece from a resilient self-lubricating plastic and includes a bushing having a concentric bore, a hinge pin having an end connected to the bushing concentrically with the bore by thin webs. The other end of the hinge pin is attached concentrically to a cylindrical plug. The bushing portions of a pair of assemblies are inserted into opposite ends of the leaf barrel and compressive force is applied to the outer ends of the plugs thereby breaking the webs and inserting the hinge pins into the bushing bores.

2 Claims, 3 Drawing Figures

HINGE PIN

BACKGROUND OF THE INVENTION

1. Field of the Invention

The present invention relates to hinge pins and bushings for screen doors and the like, and more particularly to an improved plastic hinge pin and bushing which is easily assembled with automated procedures.

2. Description of the Prior Art

In the large scale manufacture of screen doors and the like, it is common to use automated equipment in various assembly operations. Of particular interest is the hinge for aluminum frame doors. A popular design utilizes an extruded hinge leaf having a flat portion which will be screwed or riveted to the door frame and an elongated tubular barrel portion through which a hinge pin will be inserted. To provide a long wearing, low friction hinge, a nylon bushing is inserted in each end of the barrel portion of the hinge leaf. A pair of short hinge leaves is attached to the door jamb, and each jamb leaf has a nylon bushing mating with the frame hinge leaf bushing inserted therein. Thereafter, when the frame is hung on the jamb, an aluminum pin is inserted through both jamb leaves and the hinge leaf through the nylon bushings. As will be understood, the aluminum pin provides rigidity to the hinge assembly and the nylon bushings provide a low friction bearing.

It will be noted that several operations are necessary in assembling this prior art arrangement. Four bushings have to be inserted and a hinge pin must be installed with means for securing the hinge pin in place.

It is desirable to reduce the number of operations in such an assembly, to reduce the number of separate parts in stock, and to therefore reduce the time and cost of assembly.

SUMMARY OF THE INVENTION

The present invention is an improved hinge pin and bushing assembly which reduces the number of assembly operations and eliminates material. A molded pin and bushing assembly is provided formed from nylon or similar plastic material having self-lubricating properties. One end of the device includes a bushing portion having a shoulder and a tubular bushing element. Concentric with the bushing and extending therefrom is a pin assembly which is attached to the central portion of the bushing by a plurality of thin webs. The opposite end of the pin includes a solid plug portion having the same outside profile as the bushing including a flange portion. The hinge pin and bushing assembly is, as noted above, molded such that the pin is held to the bushing by pin webs of the nylon material prior to assembly. A pair of these devices is provided for each hinge assembly.

Assuming for purposes of illustration that the device is to be installed, the hinge leaf has the bushing portion inserted in one end of the barrel and the opposite end of the device is pushed so as to force the pin into the bushing by breaking the thin webs. A slightly enlarged end of the pin portion may be provided which will project slightly from the bushing when fully inserted. The faces of the bushing and the pin shoulders come together and will represent the bearing surfaces. A second hinge pin and bushing assembly is inserted in the other end of the hinge leaf which is then ready to be installed into the jamb hinge leaves. As will be understood, the plugs fit into the barrel portions of such jamb hinge leaves. For manual installation, several steps have been eliminated; however, the invention is particularly well suited for insertion by a machine with only two operations required, and only two bushing-pin elements need to be stocked and fed to the machine per hinge.

Although plastic is a preferred material due to its low cost and self-lubricating characteristics, the hinge pin and bushing assembly can be formed from aluminum or other materials known in the art. Also, the assembly can be used in any other application in which machine assembly of a pivoted element is required.

It is therefore a principal object of the invention to provide an improved low cost hinge pin and bushing assembly for screen doors and the like, which reduces the number of assembly operations, and which eliminates certain hinge elements formerly required.

It is another object of the invention to provide an improved hinge pin and bushing assembly in which the pin and bushing are molded from a self-lubricating plastic in one piece and are automatically separated during assembly.

It is still another object of the invention to provide a hinge pin and bushing assembly which will eliminate a metal pin and which is easily installed with automatic machines.

These and other objects and advantages of the invention will become apparent from the following detailed description when read in conjunction with the drawings.

DETAILED DESCRIPTION OF THE PREFERRED EMBODIMENT

Figure 1:
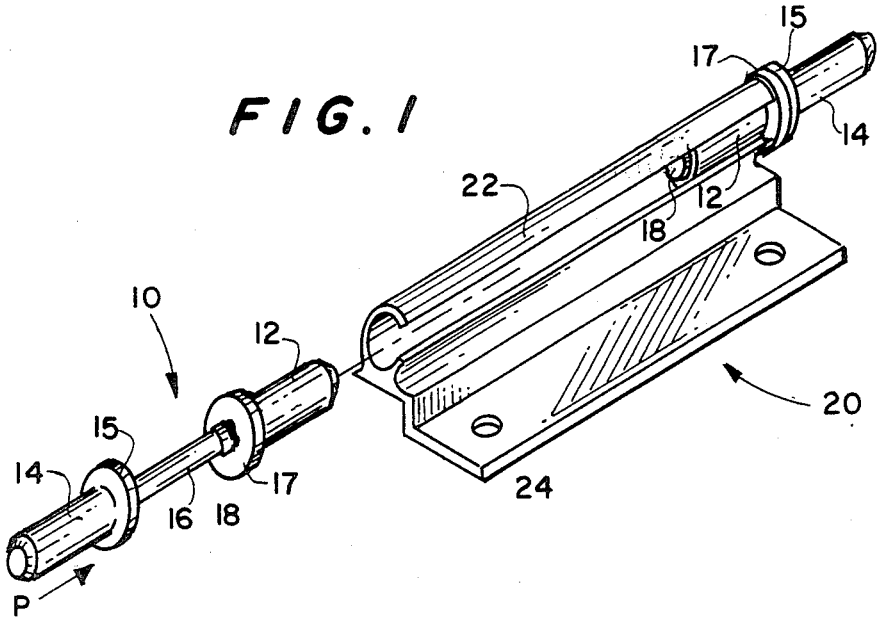
FIG. 1 is a perspective view of a hinge leaf having the hinge pin and bushing of the invention installed on one end thereof, and having the hinge pin and bushing assembly in position for installation on the other end thereof.

Turning first to FIG. 1, a typical hinge leaf 20 such as may presently be used for hanging aluminum frame screen doors and the like is shown. Hinge leaf 20 includes a mounting bracket portion 24 for attachment to the door frame. A tubular barrel portion 22 is provided which may be solid or be partially open as indicated in the figure. A pair of hinge pin and bushing assemblies of the invention are illustrated which are shown in more detail in FIGS. 2 and 3.

Figure 2:
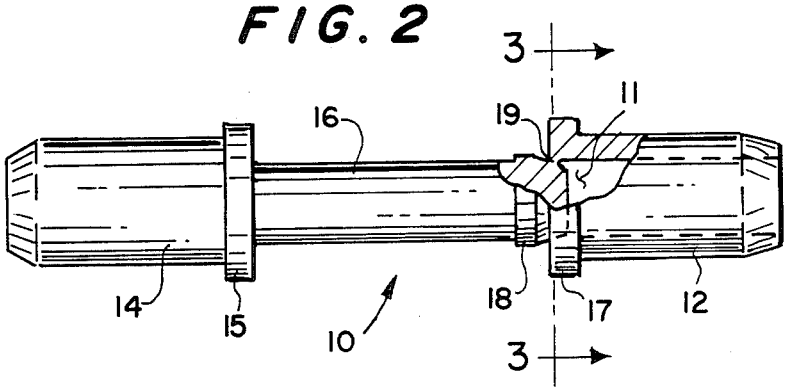
FIG. 2 is a plan view of the hinge pin and bushing assembly of the invention having a cut away portion to show the temporary connecting webs thereof.
Figure 3:
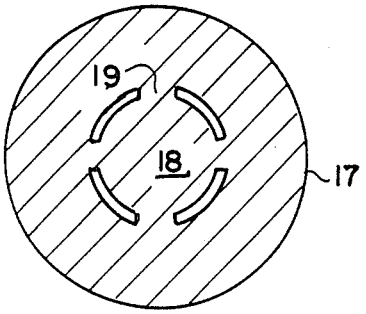
FIG. 3 is a cross-sectional view through plane 3—3 of FIG. 2 showing the temporary connecting webs.

Referring to FIG. 2, the hinge pin and bushing assembly 10 is molded in the form shown having a cylindrical bushing portion 12 with a concentric bore 11. Bushing 12 includes a shoulder and bearing portion 17. Upon assembly, as indicated in FIG. 1, bushing 12 is inserted in one end of hinge barrel 22 to the point that bushing shoulder 17 is flush with the barrel 22. Projecting from bushing 12 in FIG. 2 is seen to be a hinge pin 16 having a slightly enlarged head 18 which is attached to bushing 12 by a plurality of thin webs 19. Webs 19 are better seen in the cross-sectional view of FIG. 3. At the opposite end of hinge pin 16 is cylindrical plug 14 having a shoulder 15 similar to shoulder 17 of bushing 12. The outer ends of plug 14 and bushing 12 are tapered for ease of insertion into the respective hinge barrels.

As will now be understood, hinge pin and bushing 10 is molded in one piece with the pin portion connected to the bushing portion by the set of small webs 19. Referring to FIG. 1, when it is desired to assemble a hinge using the invention, the operator or a machine will insert the assembly into the hinge leaf barrel 22 by inserting bushing 12 to bring shoulder 17 flush with the outer end of barrel 22. Pressure as indicated by arrow P is applied to the plug 14 sufficient to break webs 19 and to force the head portion 18 of pin 16 through bore 11 of bushing 12. Simce material such as nylon is used for the device, thee is sufficient resilience to permit pin 16 to be forced through bore 11 with moderate pressure. When shoulder 15 contacts shoulder 17, pin head portion 18 will extend from the end of bushing 12 and will expand to prevent the pin portion 16 from dropping out of bushing 12 during subsequent operations. This condition of the hinge pin and bushing of the invention is indicated at the right end of the drawing of FIG. 1.

Although not shown, after hinge leaf 20 is attached to a door frame, a first jamb hinge leaf is attached to the jamb, plug 14 is inserted in that hinge leaf, and the second jamb hinge leaf is installed on plug 14 of the opposite hinge pin and bushing assembly 10 and thereafter attached to the door jamb.

Thus, the hinge leaf 20, and the hinge pin and bushing assembly 10 can be assembled in a machine ready to install on the door frame with a minimum of operations necessary thereafter for hanging the door frame in a jamb. The finished assembly requires no separate metal hinge pin yet provides a sturdy and low friction hinge since pin 16 will turn freely within bore 11 and the faces of bushing 16 and 17 will turn freely.

Although a specific embodiment has been shown, it is to be understood that this is for exemplary purposes only. Various modifications in the shape, proportions, and other characteristics of the disclosed embodiment may be made without departing from the spirit and scope of the invention.

I claim:

1. A hinge leaf assembly comprising:

(a) a hinge leaf having a barrel disposed along one edge thereof;

(b) a pair of plastic hinge pin and bearing elements each having (i) a cylindrical bushing inserted in an end of said barrel, said bushing having a cylindrical bore therethrough;

(ii) a cylindrical hinge pin element attached concentrically to a cylindrical plug element, said plug element for insertion into a jamb hinge leaf, (iii) a plurality of thin webs attaching an end of said hinge pin element to said bushing; and (c) said hinge pin and bearing elements adapted to, upon cmpressive force being applied to ends of said plug elements toward said hinge leaf barrel, permit breakage of said webs, insertion of said pin elements through said bores, and seating of said plug elements and said bushings together to form bearing surfaces.

2. The assembly as recited in claim 1 which further includes:

a first shoulder concentric with said cylindrical bushing; and a second shoulder concentric with said plug element such that said first and second shoulders form said bearing surfaces of each of said pair.

* * * * *